US011976458B1

(12) United States Patent
Gibson

(10) Patent No.: US 11,976,458 B1
(45) Date of Patent: May 7, 2024

(54) MOBILE HOME ANCHORING SYSTEM AND METHOD OF USE

(71) Applicant: James Gibson, Burleson, TX (US)

(72) Inventor: James Gibson, Burleson, TX (US)

( * ) Notice: Subject to any disclaimer, the term of this patent is extended or adjusted under 35 U.S.C. 154(b) by 0 days.

(21) Appl. No.: 17/740,006

(22) Filed: May 9, 2022

Related U.S. Application Data

(60) Provisional application No. 63/238,685, filed on Aug. 30, 2021.

(51) Int. Cl.

| | |
|---|---|
| ***E04B 1/34*** | (2006.01) |
| ***E04B 1/343*** | (2006.01) |
| *E02D 27/48* | (2006.01) |
| *E02D 27/50* | (2006.01) |

(52) U.S. Cl.
CPC ..... *E04B 1/34347* (2013.01); *E02D 27/48* (2013.01); *E02D 27/50* (2013.01)

(58) Field of Classification Search
CPC . E04B 1/34347; E04B 1/34352; E02D 27/48; E02D 27/50
See application file for complete search history.

(56) References Cited

U.S. PATENT DOCUMENTS 5,363,610 A * 11/1994 Thomas ..... E04B 1/34347 52/126.6
6,343,449 B1 * 2/2002 MacKarvich ..... E02D 27/50 52/293.3
6,748,717 B2 * 6/2004 Sumner, Sr. ..... E04B 1/34352 52/741.15
7,191,569 B2 * 3/2007 Brown ..... E04F 15/02488 52/157
7,207,149 B2 * 4/2007 Fyfe ..... E02D 27/42 156/73.2
8,844,209 B1 * 9/2014 Oliver ..... E04B 1/34347 52/157
8,920,077 B2 * 12/2014 Kruse ..... E02D 27/26 405/244

FOREIGN PATENT DOCUMENTS

GB 751775 A * 7/1956
GB 794842 A * 5/1958

* cited by examiner

*Primary Examiner* — Adriana Figueroa
(74) *Attorney, Agent, or Firm* — Richard Eldredge; Leavitt and Eldredge

(57) ABSTRACT

A mobile home anchoring system includes one or more beams extending from a first end to a second end, the one or more beams to provide structural support to a mobile home; a cable system having one or more points of contact to secure the cable to the one or more beams; a pipe embedded under a ground surface; and a concrete casing surrounding at least a portion of the pipe under the ground surface; the cable system extends into the pipe and is secured within the pipe; the cable system, pipe, and concrete casing provide for anchoring to the one or more beams to provide anchoring to the mobile home.

16 Claims, 2 Drawing Sheets

MOBILE HOME ANCHORING SYSTEM AND METHOD OF USE

BACKGROUND

1. Field of the Invention

The present invention relates generally to mobile home anchoring systems, and more specifically, to a mobile home anchoring system, which provides a means to bring mobile home structures up to code and further provides for improved resistance to corrosion.

2. Description of Related Art

Mobile home anchoring systems are well known in the art and are effective means to aid in stability of a mobile home.

One of the problems commonly associated with conventional anchoring systems is corrosion. In addition, conventional systems utilize flat straps which are only designed for load in one direction.

Accordingly, although great strides have been made in the area of mobile home anchoring systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
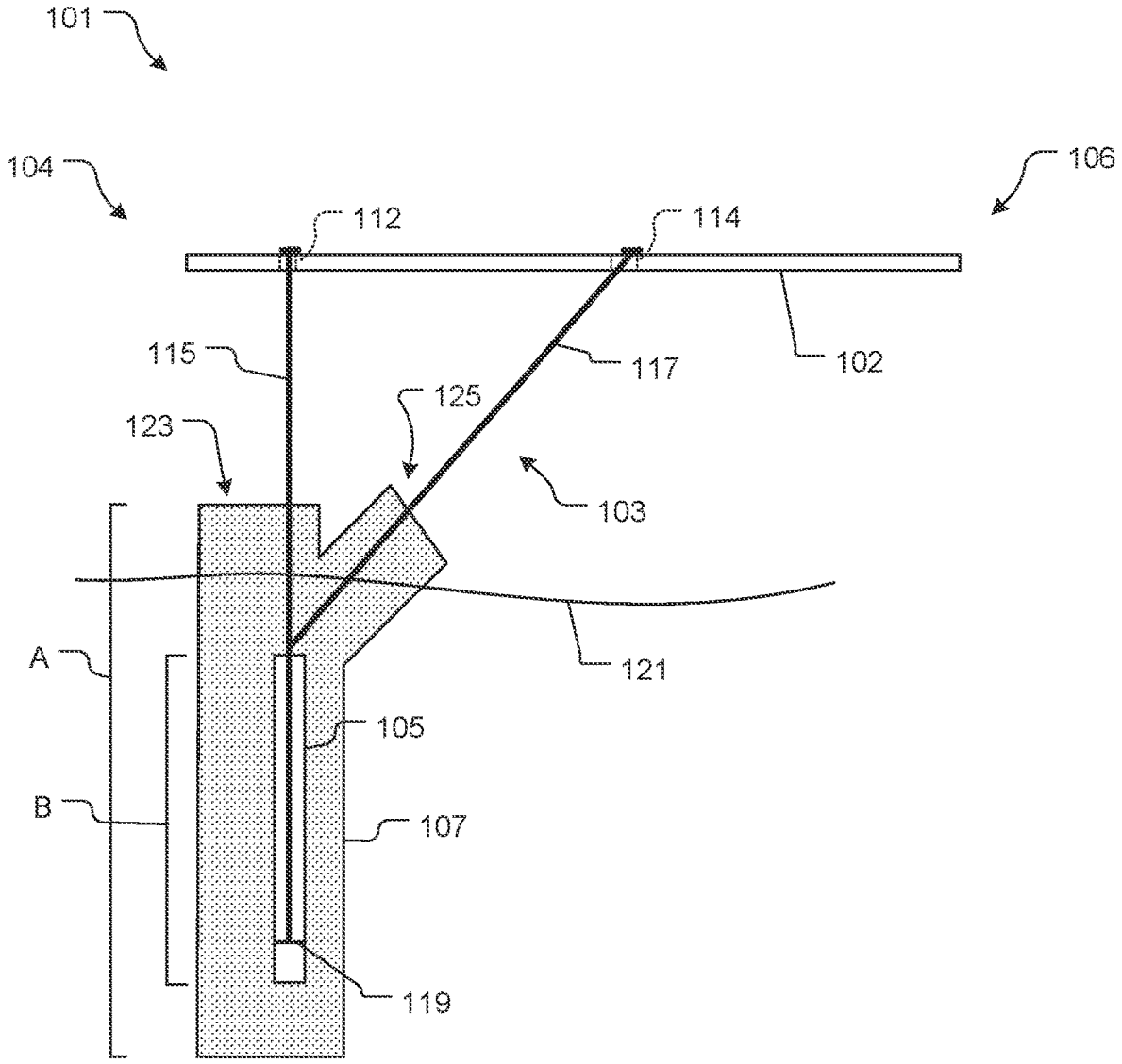
FIG. 1 is a front schematic view of an anchoring system in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional anchoring systems. Specifically, the present invention provides for an improved anchoring system that has reduced corrosion and provides for load support in multiple directions. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a front schematic view of an anchoring system 101 in accordance with a preferred embodiment of the present application. It will be appreciated that system 101 overcomes one or more of the above-listed problems commonly associated with conventional anchoring systems.

In the contemplated embodiment, system 101 includes a beam 102 extending from a first end 104 to a second end 106 and configured to provide structural support to a mobile home (not shown). It must be appreciated and understood that a system may include a plurality of beams as needed.

A cable system 103 attaches to the beam 102 at one or more points of contact and extends into a galvanized pipe 105, the galvanized pipe embedded within a concrete casing 107. As shown, the cable system provides for both a transverse and a longitudinal anchor when attached to the beam 102 supporting the mobile home.

It is contemplated that the cable system 103 may attach to the one or more beams 102 via a variety of means, in one embodiment, the cable system 103 is attached through holes 112, 114 that extend through the beam. It should be appreciated that alternative methods may be used.

As shown, in the preferred embodiment, the cable system 103 includes at least a first cable 115 and a second cable 117, wherein the first cable 115 extends vertically between the beam and the pipe 105 and wherein the second cable 117 extends at an acute angle (relative to the beam) between the beam 102 and the pipe 105. This specifically provides for improved anchoring.

It should be appreciated that one of the unique features believed characteristic of the present application is the use of galvanized cable secured within a galvanized pipe embedded within concrete. This combination of features provides for an improved anchor system.

As shown, in the preferred embodiment, the pipe 105 is completely surrounded by the concrete casing 107 and includes one or more securement devices 119 to secure the cable system 103 therein. Further as shown, the pipe 105 is positioned below a ground surface 121. In the embodiment shown, the concrete casing 107 includes a first top surface 123 and a second top surface 125 through which the cables 115, 117 extend.

It should be appreciated that the anchor system anchors the mobile home in place, thereby brining the mobile home up to code and providing for improved safety and security of the home.

It should be appreciated that the size of the pipe and cable can vary, however it will be understood by those skilled in the art that a thicker cable provides for higher tensile strength. In the preferred embodiment, pipe 105 is a galvanized pipe and has a length B of approximately 8 inches, while the cement casing 107 has a length A of approximately 36 inches. The concrete casing 107 has a diameter of approximately diameter of approximately 8 inches and the pipe has a diameter of approximately 2⅜ inches.

Figure 2:
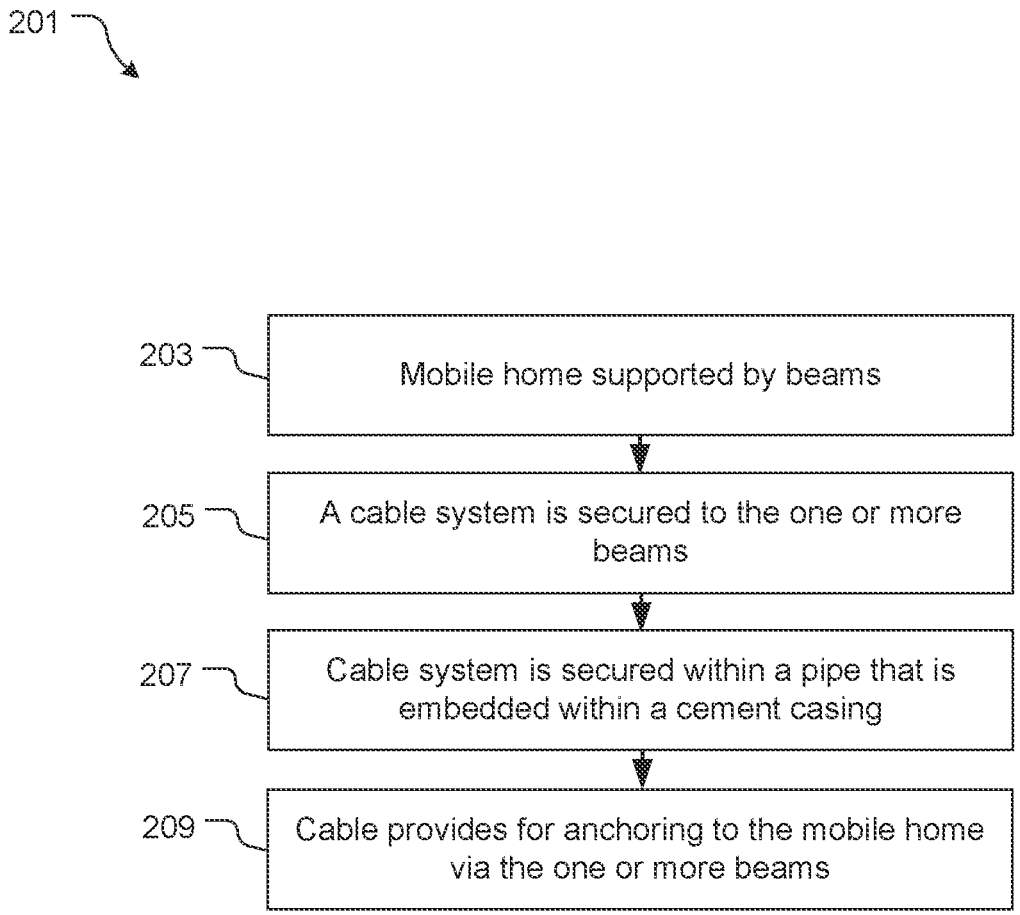
FIG. 2 is a flowchart of a method of use of the anchoring system of FIG. 1.

In FIG. 2, a flowchart 201 depicts a method of use of system 101. During use, a mobile home will be supported by one or more beams, as shown with box 203. A cable system is secured to the beam(s) and extends into and is secured within a pipe, the pipe being embedded within a cement casing underground, as shown with boxes 205, 207. The cable system thereby providing for anchoring to the mobile home, as shown with box 209.

Depending on the home being secured, the placement of the anchors may vary to provide for the best anchoring system.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A mobile home anchoring system, comprising:

one or more beams extending from a first end to a second end, the one or more beams configured to provide structural support to a mobile home;

a cable system having one or more points of contact configured to secure the cable to the one or more beams;

a pipe embedded under a ground surface; and a concrete casing surrounding at least a portion of the pipe under the ground surface;

wherein the cable system extends into the pipe and is secured within the pipe;

wherein the cable system, pipe, and concrete casing provide for anchoring to the one or more beams to provide anchoring to the mobile home;

wherein the cable system includes a first cable attached vertically to one of the one or more beams and a second cable attached at an angle less than 90 degrees to the one of the one or more beams, thereby providing both transverse and longitudinal anchoring to the one or more beams; and wherein the concrete casing has a first top surface and a second top surface such that the first cable extends through the first top surface and the second cable extends through the second top surface.

2. The system of claim 1, wherein the cable system is secured to a securement device within the pipe.

3. The system of claim 1, wherein the pipe is completely surrounded by the concrete casing.

4. The system of claim 1, wherein the pipe is a galvanized pipe.

5. The system of claim 1, wherein the concrete casing is approximately 18 inches in length.

6. The system of claim 1, wherein the concrete casing is approximately 36 inches in length.

7. The system of claim 1, wherein the concrete casing has a diameter of approximately 8 inches.

8. The system of claim 1, wherein the pipe has a diameter of approximately 2⅜ inches.

9. A method of anchoring a mobile home, the method comprising:

providing a mobile home supported on one or more beams;

securing a cable system to one or more points of contact along the one or more beams;

securing the cable system within a pipe; and embedding the pipe in the ground surface within a cement casing;

wherein the cable system, pipe, and concrete casing provide for anchoring to the one or more beams to provide anchoring to the mobile home;

wherein the cable system includes a first cable attached vertically to one of the one or more beams and a second cable attached at an angle less than 90 degrees to the one of the one or more beams, thereby providing both transverse and longitudinal anchoring to the one or more beams; and wherein the concrete casing has a first top surface and a second top surface such that the first cable extends through the first top surface and the second cable extends through the second top surface.

10. The method of claim 9, wherein the cable system is secured to a securement device within the pipe.

11. The method of claim 9, wherein the pipe is completely surrounded by the concrete casing.

12. The method of claim 9, wherein the pipe is a galvanized pipe.

13. The method of claim 9, wherein the pipe is approximately 18 inches in length.

14. The method of claim 9, wherein the concrete casing is approximately 36 inches in length.

15. The method of claim 9, wherein the concrete casing has a diameter of approximately 8 inches.

16. The method of claim 9, wherein the pipe has a diameter of approximately 2⅜ inches.

* * * * *